US008703375B2

(12) United States Patent
Shimota et al.

(10) Patent No.: US 8,703,375 B2
(45) Date of Patent: Apr. 22, 2014

(54) TONER, METHOD FOR FORMING TONER, DEVELOPER, AND IMAGE FORMING METHOD

(75) Inventors: Naohito Shimota, Shizuoka (JP); Takahiro Honda, Shizuoka (JP); Tsuneyasu Nagatomo, Shizuoka (JP); Ryuta Chiba, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 195 days.

(21) Appl. No.: 13/188,770

(22) Filed: Jul. 22, 2011

(65) Prior Publication Data

US 2012/0021347 A1 Jan. 26, 2012

(30) Foreign Application Priority Data

Jul. 22, 2010 (JP) ..... 2010-165259
Apr. 22, 2011 (JP) ..... 2011-096483

(51) Int. Cl.
*G03G 9/087* (2006.01)

(52) U.S. Cl.
USPC ..... 430/108.7; 430/108.8; 430/109.4; 430/123.51; 430/123.52; 430/137.19; 430/137.21

(58) Field of Classification Search
USPC ..... 430/108.4, 108.7, 108.8, 109.4, 137.19, 430/137.21, 123.51, 123.52
See application file for complete search history.

(56) References Cited

U.S. PATENT DOCUMENTS 6,436,599 B1 * 8/2002 Matsuoka et al. ..... 430/137.19
7,608,374 B2 * 10/2009 Tomita ..... 430/108.8
2005/0208403 A1 9/2005 Shu et al.
2005/0238988 A1 10/2005 Sugahara et al.
2006/0046178 A1 3/2006 Akiyama et al.
2007/0111127 A1 5/2007 Patel et al.
2009/0142093 A1 6/2009 Sawada et al.
2009/0142094 A1 6/2009 Sawada et al.
2010/0068641 A1 3/2010 Shimmura
2010/0075243 A1 3/2010 Shimota et al.
2011/0033794 A1 2/2011 Watanabe et al.

FOREIGN PATENT DOCUMENTS

CN 1808289 A 7/2006
EP 1 617 299 A2 1/2006
EP 1 617 299 A3 1/2006
EP 1 788 453 A1 5/2007
JP 11-44969 2/1999
JP 2006-65107 3/2006

OTHER PUBLICATIONS

Extended European Search Report issued Oct. 7, 2011, in Patent Application No. 11174995.8.
Office Action issued Jun. 21, 2012 in Chinese Application No. 201110207344.6 (With English Translation).
Office Action issued in Chinese Patent Application No. 201110207344.6 issued Sep. 9, 2013 w/ partial English translation of Office Action.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

To provide a toner A containing: base particles, each containing polyester, microcrystalline wax, and a colorant; and spherical silica particles having an average primary particle diameter of 100 nm to 150 nm, wherein the microcrystalline wax has an onset temperature of 45° C. to 60° C. as determined by DSC, and a carbon number distribution of 25 to 55.

20 Claims, 3 Drawing Sheets

TONER, METHOD FOR FORMING TONER, DEVELOPER, AND IMAGE FORMING METHOD

BACKGROUND OF THE INVENTION

1. Field of the Invention

The present invention relates to a toner, a method for forming a toner, a developer, and an image forming method.

2. Description of the Background

In recent years, an image forming method employing an electrophotographic system has been applied in a field that requires high speed printing of images of large imaging areas, such as offset printing. In such application of the image forming method, low temperature fixing ability, hot offset resistance, and heat resistance preservability of a toner are important.

There is disclosed in Japanese Patent Application Laid-Open (JP-A) No. 11-44969 an electrophotographic toner produced by a production method including a step of dissolving or dispersing at least a binder resin, a colorant, and a releasing agent in an organic solvent to prepare an oil phase component, a step of dispersing the oil phase component in an aqueous medium for granulation. The binder resin used here contains a resin of non-linear molecular structure, and the releasing agent has an onset temperature of 40° C. or higher, and a melting point of 120° C. or lower as determined by DSC.

However, the disclosed toner has a problem that the releasing agent tends to pollute an inner area of a device for use when an image having a large imaging area is printed at high speed using this toner. In addition, it has a problem that when silica particles of large particle diameters are used as external additives, such silica particles having large particle diameter tends to deposit on a photoconductor.

SUMMARY OF THE INVENTION

In the light of the problems in the conventional art, the present invention aims to provide a toner capable of preventing pollution of an inner area of a device for use by a releasing agent even when high speed printing of large-area images is performed, and preventing deposition of silica particles having large particle diameters, as well as providing a method for producing the toner. Moreover, the present invention also aims to provide a developer containing such toner, and an image forming method using such developer.

The toner of the present invention contains: base particles each containing polyester, microcrystalline wax, and a colorant; and spherical silica particles having an average primary particle diameter of 100 nm to 150 nm, in which the microcrystalline wax has an onset temperature of 45° C. to 60° C. as determined by DSC, and a carbon number distribution of 25 to 55.

The method for producing a toner of the present invention contains: dissolving or dispersing a material containing polyester prepolymer containing an isocyanate group, a compound containing an amino group, microcrystalline wax, and a colorant in an organic solvent to prepare a first fluid; emulsifying or dispersing the first fluid in an aqueous medium containing resin particles to prepare a second fluid; removing the organic solvent from the second fluid to form base particles; and mixing the base particles with spherical silica particles having an average primary particle diameter of 100 nm to 150 nm, in which the microcrystalline wax has an onset temperature of 45° C. to 60° C. as determined by DSC, and a carbon number distribution of 25 to 55.

The developer of the present invention contains the toner of the present invention.

The image forming method of the present invention contains: charging a photoconductor; exposing the charged photoconductor to light to form a latent electrostatic image; developing with the developer of the present invention the latent electrostatic image formed on the photoconductor to form a toner image; transferring the toner image formed on the photoconductor to a recording medium; and fixing the toner image transferred to the recording medium.

The present invention can provide a toner capable of preventing pollution of an inner area of a device for use by a releasing agent even when high speed printing of large-area images is performed, and preventing deposition of silica particles having large particle diameters, as well as providing a method for producing such toner. Moreover, the present invention can provide a developer containing such toner, and an image forming method using such the developer.

DETAILED DESCRIPTION OF THE INVENTION

Figure 1:
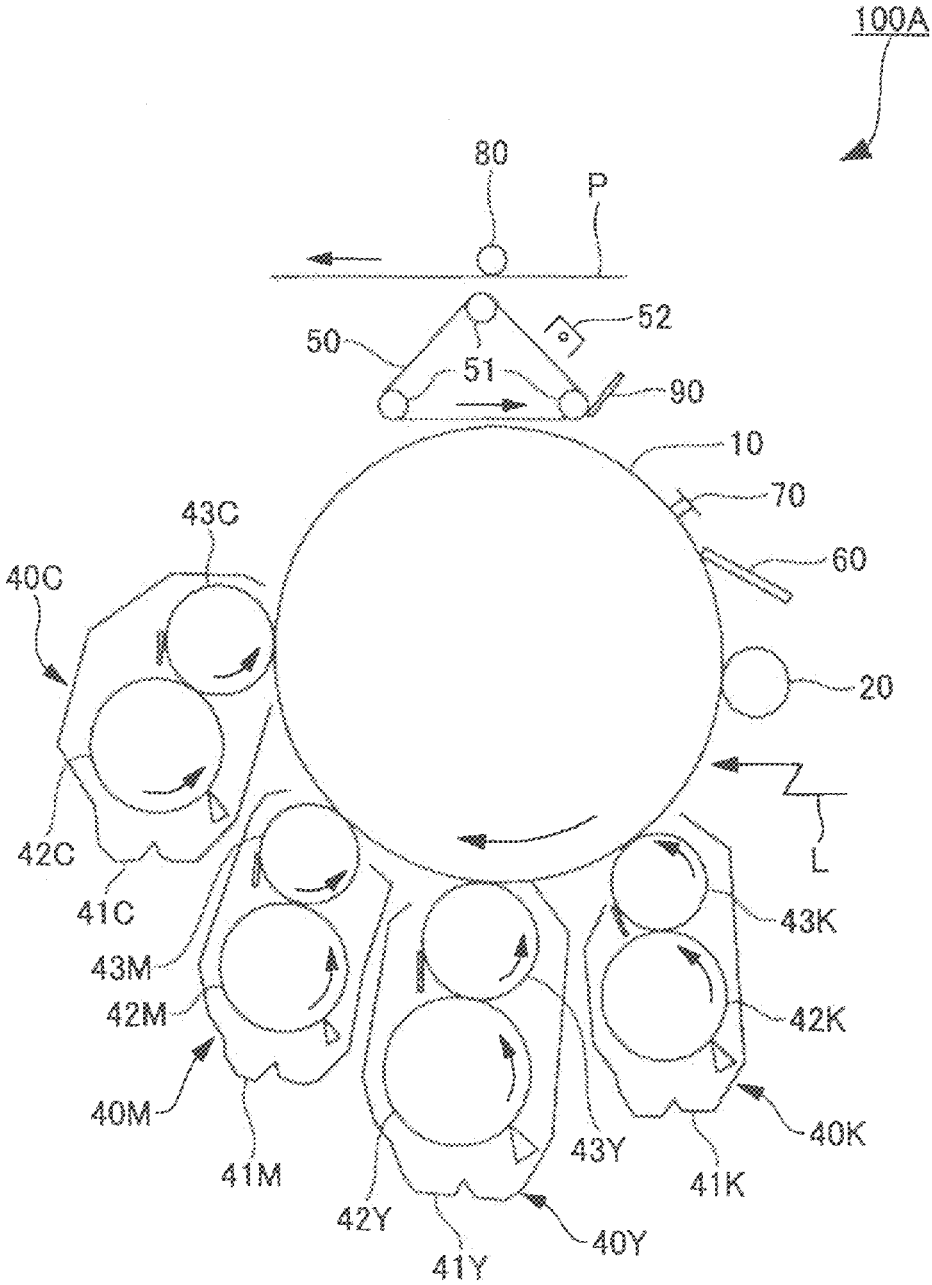
FIG. 1 is a diagram illustrating one example of an image forming apparatus used in the present invention.

Embodiments of the present invention will be explained with reference to drawings, hereinafter.

Toner

The toner of the present invention contains base particles, each of which contains polyester serving as a binder resin, microcrystalline wax serving as a releasing agent, and a colorant, and spherical silica particles having an average primary particle diameter of 100 nm to 150 nm, and the microcrystalline wax used herein has an onset temperature of 45° C. to 60° C. as determined by DSC, and a carbon number distribution of 25 to 55.

In the present specification, the term "onset temperature" means a temperature at which a DSC curve of a sample (i.e. microcrystalline wax) shows the first indication of phase transition. Microcrystalline Wax In the case where the microcrystalline wax is used as a releasing agent, the resulting toner has inferior releasing properties compared to the case where paraffin wax is used as a releasing agent. However, use of the microcrystalline wax as a releasing agent can prevent a contamination inside the apparatus for use by the releasing agent, even if an image of large area is printed at high speed. In the present invention, the aforementioned specific microcrystalline wax is used to improve the releasing properties of the resulting toner. In the case where the microcrystalline wax described in Example of JP-A No. 11-44969, which does not have the properties specified in the present invention, is used, it cannot provide a toner having sufficient releasing properties to print an image of large area at high speed.

An amount of the microcrystalline wax in the toner is appropriately selected depending on the intended purpose without any restriction. For example, the amount thereof is 1% by mass to 30% by mass. When the amount of the microcrystalline wax in the base particles is less than 1% by mass, the hot-offset resistance of the resulting toner lowers. When the amount thereof is more than 30% by mass, toner filming and fogging of an image may occur.

Spherical Silica Particles

It has not been clarified the reason, but depositions of the spherical silica particles to a photoconductor can be prevented when the spherical silica particles having an average primary particle diameter of 100 nm to 150 nm are fixed onto the base particles containing the microcrystalline wax having an onset temperature of 45° C. to 60° C. as determined by DSC, and a carbon number distribution of 25 to 55, better than when the spherical silica particles having an average primary particle diameter of 100 nm to 150 nm are fixed onto base particles containing paraffin wax.

The average primary particle diameter of the spherical silica particles can be measured, for example, by a laser diffraction/scattering particle size analyzer (LA-920, manufactured by Horiba, Ltd.)

Polyester

The polyester preferably contains urea-modified polyester. Use of the urea-modified polyester in the polyester can improve the hot-offset resistance of the resulting toner while maintaining the low temperature fixing ability of the toner.

Urea-Modified Polyester

The urea-modified polyester can be synthesized by reacting a polyester prepolymer containing an isocyanate group and a compound containing an amino group. The polyester prepolymer containing an isocyanate group can be synthesized by reacting polyester containing a hydroxy group and polyvalent isocyanate.

The polyester containing a hydroxy group is obtained through a dehydration-condensation reaction between polyhydric alcohol and polycarboxylic acid.

The polyhydric alcohol is appropriately selected depending on the intended purpose without any restriction, and examples thereof include: dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and alkylene oxide adducts such as ethylene oxide or propylene oxide of bisphenol A; and trihydric or higher polyhydric alcohols such as sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylol ethane, trimethylol propane, and 1,3,5-trihydroxybenzene. These may be used independently, or in combination.

The polycarboxylic acid is appropriately selected depending on the intended purpose without any restriction, and examples thereof include: benzene dicarboxylic acid such as phthalic acid, isophthalic acid, and terephthalic acid; alkyl dicarboxylic acid such as succinic acid, adipic acid, sebacic acid, and azelaic acid; unsaturated dibasic acid such as maleic acid, citraconic acid, itaconic acid, alkenyl succinic acid, fumaric acid, and mesaconic acid; trivalent, or higher polycarboxylic acid such as trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetrakis(methylenecarboxy)methane, 1,2,7,8-octane tetracarboxylic acid, and empol trimer acid. These may be used independently, or in combination.

Anhydrides, lower alkyl esters or the like of polycarboxylic acid may be used instead of the aforementioned polycarboxylic acid.

The polyvalent isocyanate is appropriately selected depending on the intended purpose without any restriction, and examples thereof include: aliphatic polyvalent isocyanate (e.g. tetramethylene diisocyanate, hexamethylene diisocyanate, and 2,6-diisocyanate methyl caproate); alicyclic polyisocyanate (e.g. isophorone diisocyanate, and cyclohexylmethane diisocyanate); aromatic diisocyanate (e.g. tolylene diisocyanate, and diphenylmethane diisocyanate); aromatic aliphatic diisocyanate (e.g. α,α,α',α'-tetramethyl xylylene diisocyanate); and isocyanirates. These may be used independently, or in combination.

A compound in which an isocyanate group of polyvalent isocyanate is blocked with a phenol derivative, oxime, caprolactam, or the like may be used instead of the aforementioned polyvalent isocyanate.

When the polyester containing a hydroxy group and the polyvalent isocyanate are reacted, an equivalent mass ratio of the isocyanate groups in the polyvalent isocyanate to the hydroxy groups contained in the polyester containing a hydroxy group (isocyanate group/hydroxy group) is generally 1 to 5, preferably 1.2 to 4, and even more preferably 1.5 to 2.5.

The number of isocyanate groups per molecular of the polyester prepolymer containing an isocyanate group is generally 1 or more, preferably 1.5 to 3, and even more preferably 1.8 to 2.5.

Examples of the compound containing an amino group include a bivalent amine, tri or higher valent amine, amino alcohol, amino mercaptan, and amino acid.

The bivalent amine is appropriately selected depending on the intended purpose without any restriction, and examples thereof include: aromatic diamine (e.g. phenylene diamine, diethyl toluene diamine, and 4,4'-diaminodiphenyl methane); alicyclic diamine (e.g. 4,4'-diamino-3,3'-dimethyldichlorohexyl methane, diamine cyclohexane, and isophorone diamine); and aliphatic diamine (e.g. ethylene diamine, tetramethylene diamine, and hexamethylene diamine).

The tri or higher valent amine is appropriately selected depending on the intended purpose without any restriction, and examples thereof include diethylene triamine, and triethylene tetramine.

The amino alcohol is appropriately selected depending on the intended purpose without any restriction, and examples thereof include ethanol amine, hydroxyethyl aniline.

The amino mercaptan is appropriately selected depending on the intended purpose without any restriction, and examples thereof include aminoethylmercaptan, and aminopropylmercaptan.

The amino acid is appropriately selected depending on the intended purpose without any restriction, and examples thereof include amino propionic acid, and amino caproic acid.

Examples of the compound containing an amino group further include a compound containing an amino group in which the amono group is blocked with ketones (e.g. acetone, methyl ethyl ketone, and methyl isobutyl ketone), such as ketimine, and oxazolidine.

When the polyester prepolymer containing an isocyanate group and the compound containing an amino group are reacted, an equivalent mass ratio of the isocyanate groups contained in the polyester prepolymer containing an isocyanate group to the amino groups contained in the compound containing an amino group (isocyanate group/amino group) is generally 0.5 to 2, preferably 2/3 to 1.5, and even more preferably 5/6 to 1.2.

The polyester preferably contains unmodified polyester in combination with the urea-modified polyester. When the unmodified polyester is contained in the polyester, low temperature fixing ability and storage stability of the resulting toner improves.

Unmodified Polyester

The unmodified polyester is obtained through a dehydration condensation reaction between polyhydric alcohol and polycarboxylic acid.

The polyhydric alcohol is appropriately selected depending on the intended purpose without any restriction, and examples thereof include: dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and alkylene oxide adducts such as ethylene oxide or propylene oxide of bisphenol A; and trihydric or higher polyhydric alcohols such as sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylol ethane, trimethylol propane, and 1,3,5-trihydroxybenzene. These may be used independently, or in combination.

The polycarboxylic acid is appropriately selected depending on the intended purpose without any restriction, and examples thereof include: benzene dicarboxylic acid such as phthalic acid, isophthalic acid, and terephthalic acid; alkyl dicarboxylic acid such as succinic acid, adipic acid, sebacic acid, and azelaic acid; unsaturated dibasic acid such as maleic acid, citraconic acid, itaconic acid, alkenyl succinic acid, fumaric acid, and mesaconic acid; trivalent, or higher polycarboxylic acid such as trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxypropane, tetrakis(methylenecarboxy)methane, 1,2,7,8-octane tetracarboxylic acid, and empol trimer acid. These may be used independently, or in combination.

Anhydrides, lower alkyl esters or the like of polycarboxylic acid may be used instead of the aforementioned polycarboxylic acid.

An acid value of the unmodified polyester is generally 5 mgKOH/g to 40 mgKOH/g, preferably 10 mgKOH/g to 30 mgKOH/g. When the acid value of the unmodified polyester is less than 5 mgKOH/g, the compatibility between the resulting toner and paper reduces, which may lower the low temperature fixing ability of the resulting toner. When the acid value thereof is more than 40 mgKOH/g, the resulting toner tends to be easily affected by the surrounding environment in the environment such as a high temperature high humidity environment, and low temperature low humidity environment, which may degrade an image quality.

The hydroxy value of the unmodified polyester is generally 5 mgKOH/g to 100 mgKOH/g, preferably 20 mgKOH/g to 60 mgKOH/g. When the hydroxy value of the unmodified polyester is less than 5 mgKOH/g, the compatibility between the resulting toner and paper reduces, which may lower the low temperature fixing ability of the resulting toner. When the hydroxy value thereof is more than 100 mgKOH/g, the resulting toner tends to be easily affected by the surrounding environment in the environment such as a high temperature high humidity environment, and low temperature low humidity environment, which may degrade an image quality.

In view of the fixing ability and offset resistance of the resulting toner, the unmodified polyester preferably has a THF insoluble component whose molecular weight generally has a peak in the region of $3\times10^3$ to $5\times10^4$, preferably $5\times10^3$ to $2\times10^4$ in its molecular weight distribution.

Moreover, an amount of the THF insoluble component of the unmodified polyester having the molecular weight of $1\times10^6$ or lower is preferably 60% by mass to 100% by mass.

Note that, the molecular weight distribution of the unmodified polyester can be measured by means of gel permeation chromatography (GPC) using THF as an eluent.

The glass transition temperature of the unmodified polyester is generally 55° C. to 80° C., preferably 60° C. to 75° C. in view of the preservability of the toner. When the glass transition temperature of the unmodified polyester is lower than 55° C., the storage stability of the toner may degrade. When the glass transition temperature thereof is higher than 80° C., the low temperature fixing ability of the toner may degrade.

The base particles may further contain other binder resin than the aforementioned polyester. The binder resin other than the polyester is appropriately selected depending on the intended purpose without any restriction, and examples thereof include: homopolymers or copolymers of styrene-based monomers, acryl-based monomers, and methacryl-based monomers; and other resins such as polyol resins, phenol resins, silicone resins, polyurethane, polyamide, furan resins, epoxy resins, xylene resins, terpene resins, coumarone-indene resins, polycarbonate, and petroleum resins. These may be used independently, or in combination.

Colorant

The colorant is appropriately selected depending on the intended purpose without any restriction, provided that it is a dye or a pigment, and examples thereof include: carbon black, nigrosine dye, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fiser Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian green, emerald green, pigment green B, naphthol green B, green gold, acid green lake, malachite green lake, phthalocyanine green, anthraquinone green, titanium oxide, zinc flower, lithopone, and the like. These may be used independently, or in combination.

An amount of the colorant in the toner is appropriately selected depending on the intended purpose without any restriction, but it is generally 1% by mass to 15% by mass, preferably 5% by mass to 12% by mass. When the amount of the colorant in the toner is less than 1% by mass, coloring ability of the toner may reduce. When the amount thereof is more than 15% by mass, a dispersion failure of the pigment for use may occur in the toner, and speadablity of the toner may reduces during fixing due to the filling effect.

As the colorant, a master batch, which is obtained by combining a pigment and a resin together, may be used.

The resin used in the master batch is appropriately selected depending on the intended purpose without any restriction, and examples thereof include polyester, styrene-based homopolymer, styrene-based copolymer, polymethyl methacrylate, polybutyl methacrylate, polyvinyl chloride, polyvinyl acetate, polyethylene, polypropylene, an epoxy resin, an epoxypolyol resin, polyurethane, polyamide, polyvinyl butyral, polyacrylic acid, rosin, modified rosin, a terpene resin, an aliphatic hydrocarbon resin, an alicyclic hydrocarbon resin, an aromatic petroleum resin, chlorinated paraffin, and paraffin wax. These may be used independently, or in combination.

Examples of the styrene-based homopolymer include polystyrene, poly(p-chlorostyrene), and polyvinyl toluene.

The styrene-based copolymer is appropriately selected depending on the intended purpose without any restriction, and examples thereof include a styrene-p-chlorostyrene copolymer, a styrene-propylene copolymer, a styrene-vinyltoluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer.

The master batch can be prepared by mixing or kneading a pigment and a resin by means of a dispersing device of high shear force. To enhance the interaction between the pigment and the resin, an organic solvent is preferably added during the preparation of the master batch. A so-called flashing method is preferably used for the preparation of the master batch as a wet cake of the pigment can be directly used without drying the cake. The flashing method is a method in which an aqueous paste containing a pigment is mixed and kneaded with a resin and an organic solvent to transfer the pigment to the resin, and water content and organic solvent component are removed.

Modified Layered Inorganic Mineral

The base particles each preferably contain a modified layered inorganic mineral in which at least part of interlayer cations is substituted with organic ions. By using the modified layered inorganic mineral in each base particle, the shapes of the base particles can be appropriately can modified without degrading the low temperature fixing ability of the resulting toner.

The modified layered inorganic mineral is a layered inorganic minerals in which layers of an inorganic mineral each having a thickness of a few nanometers are laminated, and at least part of interlayer cations thereof is substituted with organic ions (see Japanese Translation of PCT International Application (JP-A) Nos. 2003-515795, 2006-500605, and 2006-503313). Since the modified layered inorganic mineral has an appropriate degree of hydrophobicity, it can give the first fluid, which will be mentioned later, non-Newtonian viscosity, which can irregularly shape the toner.

The layered inorganic mineral is appropriately selected depending on the intended purpose without any restriction, and examples thereof include montmorillonite, bentonite, hectorite, attapulgite, and sepiolite. These may be used independently, or in combination. Among them, the montmorillonite and bentonite are preferably used, as the resulting modified layered inorganic mineral can adjust the viscosity of the first fluid with a small amount thereof.

The organic ion (organic cation) is appropriately selected depending on the intended purpose without any restriction, and examples thereof include: quaternary alkyl ammonium salts such as trimethylstearyl ammonium, dimethylstearylbenzyl ammonium, dimethyloctyldecyl ammonium, and oleylbis(2-hydroxyethyl)methyl ammonium; phosphonium salts; and imidazolium salts. Among them, the quaternary alkyl ammonium salts are preferable.

Examples of the commercially available layered inorganic mineral include: quaternium-18 bentonite such as BENTONE series (e.g. BENTONE 3, BENTONE 38, BENTONE 38V) manufactured by Rheox, TIXOGEL VP manufactured by United Catalyst Inc., CLAYTONE series (e.g. CLAYTONE 34, CLAYTONE 40, and CLAYTONE XL) manufactured by Southern Clay Product, Inc.; stearalkonium bentonite such as BENTONE 27 manufactured by Rheox, TIXOGEL LG manufactured by United Catalyst Inc., and CLAYTONE series (e.g. CLAYTONE AF and CLAYTONE APA) manufactured by Southern Clay Product, Inc.; and quaternium-18 benzalkonium bentonite such as CLAYTONE series (e.g. CLAYTONE HT and CLAYTONE PS) manufactured by Southern Clay Products, Inc. Among them, CLAYTONE AF and CLAYTONE APA are preferable.

Moreover, in the case where the interlayer cation present in the layered inorganic mineral includes a bivalent cation, the bivalent cation can be substituted with a trivalent cation and an organic anion.

The organic anion is not particularly restricted, and examples thereof include sulfuric acid ion, sulfonic acid ion, carboxylic acid ion, and phorphoric acid ion, each having a linear, brancked, or cyclic alkyl (C1 to C44), alkenyl (C1 to C22), alkoxy (C8 to C32), hydroxyalkyl (C2 to C22), ethylene oxide, propylene oxide, or the like. Among them, carboxylic acid ion containing an ethylene oxide skeleton is preferable.

Examples of the commercial product of the modified layered inorganic mineral that has been modified with the organic nion include DHT-4A (manufactured by Kyowa Chemical Industry Co., Ltd.) modified with an organic anion of the following general formula:

$$R_1(OR_2)_nOSO_3—$$

In the formula above, $R_1$ is a C13 alkyl group, $R_2$ is a C2-6 alkylene group, and n is an integer of 2 to 10.

Examples of the commercially available product of the compound having the aforementioned organic anion include HITENOL 330T (manufactured by DAI-ICHI KOGYO SEIYAKU CO., LTD.)

An amount of the modified layered inorganic mineral in the toner is appropriately selected depending on the intended purpose without any restriction, but it is preferably 0.05% by mass to 2% by mass.

Resin Particles

It is preferred that resin particles be present on a surface of each base particle.

A material for forming the resin particles is appropriately selected depending on the intended purpose without any restriction, provided that the resulting resin particles can be dispersed in water. Examples of the material for forming the resin particles include vinyl resins, urethane resins, epoxy resins, polyester, polyamide, polyimide, silicone resins, phenol resins, melamine resins, urea resins, aniline resins, iomer resins, and polycarbonate. These may be used independently, or in combination.

Among them, the vinyl resins, urethane resins, epoxy resins, and polyester resins are preferable, and the vinyl resin is more preferable, as they can form fine spherical resin particles, and by using such resin particles, an aqueous dispersion thereof can be easily obtained.

Examples of the vinyl resin include styrene-(meth)acrylate copolymers, styrene-butadiene copolymers, (meth)acrylate-acrylate copolymers, styrene-acrylonitrile copolymers, styrene-maleic anhydride copolymers, and styrene-(meth)acrylate copolymers.

The resin particles are generally produced in the form of an aqueous dispersion of the resin particles. Note that, in the course of the production of the base particles, the aqueous dispersion of the resin particles may be used as it is, or only the resin particles contained in the aqueous dispersion of the resin particles may be used. In the case where only the resin particles contained in the aqueous dispersion containing the resin particles are used, the resin particles are obtained, for example, by washing the aqueous dispersion containing the resin particles with water, and subjected to vacuum drying.

The resin particles are preferably synthesized using a monomer having a plurality of unsaturated groups.

An amount of the monomer having a plurality of unsaturated groups for use is generally 0.3% by mass to 20% by mass, more preferably 0.5% by mass to 5% by mass, relative to the total amount of the monomers. When the amount of the monomer having a plurality of unsaturated groups is less than 0.3% by mass, the crosslink density of the resulting resin particles is insufficient. When the amount thereof is more than 20% by mass, the resulting resin particles have low adhesion to surfaces of base particles.

The monomer having a plurality of unsaturated groups is appropriately selected depending on the intended purpose without any restriction, and examples thereof include sodium salt of sulfate ester of methacrylic acid ethylene oxide adduct, ELEMINOL RS-30 (available from Sanyo Chemical Industries, Ltd.).

A synthesis method of the resin particles is appropriately selected depending on the intended purpose without any restriction, and examples thereof include soap-free emulsification polymerization, suspension polymerization, and dispersion polymerization.

The weight average molecular weight of the resin particles is generally $9\times10^3$ to $2\times10^5$, preferably $1\times10^4$ to $5\times10^4$. When the weight average molecular weight of the resin particles is less than $9\times10^3$, the heat resistance preservability of the resulting toner may be low. When the weight average molecular weight thereof is more than $2\times10^5$, the low temperature fixing ability of the toner may be low.

The weight average molecular weight of the resin particles can be measured using GPC.

The volume average particle diameter of the resin particles is generally 20 nm to 400 nm, preferably 30 nm to 200 nm, and even more preferably 40 nm to 120 nm. When the volume average particle diameter thereof is smaller than 20 nm, the resin particles hinder the adhesion between the binder resin and a recording medium, which may lower the low temperature fixing ability of the resulting toner. When the volume average particle diameter thereof is larger than 400 nm, the resin particles may be isolated from the toner due to the stress applied by the stirring during the developing.

The volume average particle diameter of the resin particles can be measured by means of a particle size distribution analyzer, NANOTRAC UPA-150EX, manufactured by NIKKISO CO., LTD.

A glass transition temperature of the resin particles is generally 40° C. to 150° C., preferably 45° C. to 80° C. When the glass transition temperature of the resin particles is lower than 40° C., the heat resistance during storage may be low. When the glass transition temperature thereof is higher than 150° C., the low temperature fixing ability of the toner may be poor.

The glass transition temperature of the resin particles can be measured by means of a differential scanning calorimeter DSC-60, manufactured by Shimadzu Corporation.

An amount of the resin particles in the toner is generally 0.2% by mass to 6.0% by mass. When the amount of the resin particles in the toner is less than 0.2% by mass, the heat resistance of the toner during the storage may be low. When the amount thereof is more than 6.0% by mass, the resin particles present on a surface of each base particle of the toner may be isolated therefrom by the stress applied by the stirring during the developing.

The amount of the resin particles in the toner can be calculated from a peak area originated only from the resin particles, measured by using phylosis gas chromatograph mass spectrometer.

Other Components

The toner of the present invention may further contain a charge controlling agent, a flow improver, an auxiliary cleaning agent, and the like, as other components.

Charge Controlling Agent

The charge controlling agent is appropriately selected depending on the intended purpose without any restriction, and examples thereof include nigrosin dyes, triphenylmethane dyes, chromium-containing metal complex dyes, chelate molybdate pigments, rhodamine dyes, alkoxy amines, quaternary ammonium salts (including fluorine modified quaternary ammonium salts), alkyl amides, phosphorous itself or compounds thereof, tangsten itself or compounds thereof, fluorosurfactants, salicylic acid metal salts, and metal salts of salicylic acid derivatives. These may be used independently, or in combination.

Examples of the commercially available charge controlling agent include: BONTRON 03 (a nigrosin dye), BONTRON P-51 (a quaternary ammonium salt), BONTRON S-34 (a metal-containing azo dye), E-82 (a oxynaphthoic acid metal complex), E-84 (a salicylic acid metal complex), and E-89 (a phenol condensate), all of which are manufactured by Orient Chemical Industries Ltd.; TP-302, and TP-415 (both quaternary ammonium salt-molybdenum complexes) manufactured by Hodogaya Chemical Co., Ltd.; Copy Charge PSY VP2038 (a quaternary ammonium salt), Copy Blue PR (a triphenyl methane derivative), Copy Charge NEG VP2036, and Copy Charge NX VP434 (both quaternary ammonium salts) manufactured by Hochst; LRA-901, and LR-147 (a boron complex), manufactured by Japan Carlit Co., Ltd.; and others such as copper phthalocyanine, perylene, quinacridone, azo pigments, and high molecular compounds each having a functional group such as a sulfonic acid group, carboxyl group, or quaternary ammonium salt group.

A mass ratio of the charge controlling agent to the binder resin (the mass of the charge controlling agent/the mass of the binder resin) is generally 0.1% to 10%, preferably 0.2% to 5%. When the mass ratio thereof is lower than 0.1%, the charging ability of the resulting toner may be insufficient. When the mass ratio thereof is higher than 10%, electrostatic attraction between the toner and a developing roller increases, which may lower the flowability of the resulting toner, or decrease image density of an image formed with the resulting toner.

Flow Improver

The flow improver generally has an average primary particle diameter of 5 nm to 100 nm.

A material for forming the flow improver is appropriately selected depending on the intended purpose without any restriction, and examples thereof include silica, almina, titanium oxide, barium titanate, magnesium titanate, calcium titanate, strontium titanate, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide, and silicon nitride. These may be used independently, or in combination.

An amount of the flow improver for use in the toner is generally 0.01% by mass to 5.0% by mass, preferably 0.01% by mass to 2.0% by mass.

Moreover, it is preferred that the flow improver be subjected to hydrophobic processing. By treating the flow improver to give hydrophobic properties, the resulting flow improver can prevent reduction in the flowability of the toner in the high humidity environment.

A treating agent for use in the hydrophobic processing of the flow improver is appropriately selected depending on the intended purpose without any restriction, and examples thereof include a silane coupling agent, a silylating agent, a fluorinated alkyl group-containing silane coupling agent, an organic titanate-based coupling agent, an aluminum-based coupling agent, silicone oil, and modified silicone oil.

The toner of the present invention further contains as the flow improver hydrophobic-processed silica particles having an average primary particle diameter of 10 nm to 30 nm, and a free particle rate of the spherical silica particles and the hydrophobic-processed silica particles, i.e. a free particle rate of all of the silica particles, is preferably 30% by mass or less, and an amount of the spherical silica particles in all of the free silica particles (i.e. the free spherical silica particles and hydrophobic-processed silica particles) is preferably 50% by volume or less. When the free particle rate of the silica particles is higher than 30% by mass, the silica particles may pollute the surrounding area of a sheet discharging section in a fixing section. When the amount of the spherical silica particles contained in the free silica particles is larger than 50% by volume, the silica particles may deposit on a photoconductor.

Auxiliary Cleaning Agent

The auxiliary cleaning agent is appropriately selected depending on the intended purpose without any restriction, and examples thereof include fatty acid metal salt such as zinc stearate, and calcium stearate.

The average circularity of the toner of the present invention is appropriately selected depending on the intended purpose without any restriction, but it is generally 0.94 to 0.98. When the average circularity of the toner of the present invention is less than 0.94, the transfer ability of the toner reduces, which may unable to form images of high image quality without any dust spots. When the average circularity thereof is more than 0.98, the cleaning ability of the toner may be low.

Note that, the average circularity of the toner can be measured by a flow particle image analyzer FPIA-2100 (manufactured Sysmex Corporation).

The volume average particle diameter of the toner of the present invention is appropriately selected depending on the intended purpose without any restriction. For example, the volume average particle diameter of the toner is generally 3 μm to 8 μm. When the volume average particle diameter of the toner is smaller than 3 μm, particles of the toner tend to be easily fused. When the volume average particle diameter thereof is larger than 8 μm, it may be difficult to form high quality images using such toner.

A mass of the volume average particle diameter of the toner to the number average particle diameter of the toner is appropriately selected depending on the intended purpose without any restriction, but it is generally 1.00 to 1.25, preferably 1.05 to 1.20. When the ratio thereof is higher than 1.25, it may be difficult to form high quality images using such toner.

The particle size distribution of the toner can be measured by a particle sizer COULTER COUNTER TAII (manufactured by Coulter Electronics).

Method for Producing Toner

The method for producing a toner of the present invention contains: dissolving or dispersing a material containing polyester prepolymer containing an isocyanate group, a compound containing an amino group, microcrystalline wax, and a colorant in an organic solvent to prepare a first fluid; emulsifying or dispersing the first fluid in an aqueous medium containing resin particles to prepare a second fluid; removing the organic solvent from the second fluid to form base particles; and mixing the base particles with spherical silica particles.

First Fluid Preparation Step

The first fluid preparation step is dissolving or dispersing a toner material in an organic solvent to prepare a first fluid.

Toner Material

The toner material contains at least the polyester prepolymer containing an isocyanate group, the compound containing an amino group, the microcrystalline wax, and the colorant.

The toner material preferably further contains unmodified polyester.

A mass ratio of the polyester prepolymer containing an isocyanate group to the unmodified polyester (polyester prepolymer containing an isocyanate group/unmodified polyester) is generally 5/95 to 25/75, preferably 10/90 to 25/75. When this mass ratio is less than 5/95, the host offset resistance of the resulting toner may be low. When the mass ratio thereof is more than 25/75, the low temperature fixing ability of the resulting toner, and glossiness of the resulting images formed using the toner may be low.

Organic Solvent

The organic solvent is appropriately selected depending on the intended purpose without any restriction, and examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, and methyl isobutyl ketone. These may be used independently, or in combination. Among them, toluene, xylene, benzene, methylene chloride, 1,2-dichloroethane, chloroform, carbon tetrachloride and the like are preferable, and ethyl acetate is particularly preferable.

An amount of the organic solvent for use is appropriately selected depending on the intended purpose without any restriction, but it is generally 40 parts by mass to 300 parts by mass, preferably 60 parts by mass to 140 parts by mass, and more preferably 80 parts by mass to 120 parts by mass, relative to 100 parts by mass of the toner material.

Second Fluid Preparation Step

The second fluid preparation step is appropriately selected depending on the intended purpose without any restriction, provided that it contains emulsifying or dispersing the first fluid in an aqueous medium containing resin particles to prepare a second fluid.

Aqueous Medium Containing Resin Particles

The aqueous medium containing resin particles is an aqueous medium in which the resin particles are dispersed in water. The aqueous medium may contain a solvent miscible to water in combination with the water.

Examples of the solvent miscible to water include: alcohols such as methanol, isopropanol, and ethylene glycol; cellsolves such as dimethylformamide, tetrahydrofuran, and methyl cellsolve; and lower ketones such as acetone, and methyl ethyl ketone. These may be used independently, or in combination. Among them, the organic solvent contained in the first liquid is preferable. In the organic solvent contained in the first liquid is used, it is preferred that water be saturated with the organic solvent contained in the first liquid.

An amount of the resin particles in the aqueous medium containing resin particles is appropriately selected depending on the intended purpose without any restriction, but it is generally 0.5% by mass to 10% by mass.

It is more preferred that the aqueous medium further contain a water-soluble polymer.

The water-soluble polymer is not particularly restricted, and examples thereof include sodium carboxymethyl cellulose, hydroxyethyl cellulose, and polyvinyl alcohol. These may be used independently, or in combination.

A disperser used for emulsifying or dispersing the first fluid in the aqueous medium containing the resin particles is appropriately selected depending on the intended purpose without any restriction, and examples thereof include a low-speed shear disperser, high-speed shear disperser, friction disperser, high-pressure jet disperser, and supersonic disperser. Among them, the high-speed shear disperser is preferable as use thereof enables to control a diameter of dispersed droplets (oil droplets) of the first fluid within the range of 2 μm to 20 μm.

The rotational speed of the high-speed shear disperser is generally 1,000 rpm to 30,000 rpm, preferably 5,000 rpm to 20,000 rpm. In the case where a batch system is employed, the duration for dispersion is generally 0.1 minutes to 5 minutes. Moreover, the temperature for dispersion is generally 0° C. to 150° C., preferably 40° C. to 98° C., under pressure.

Base Particles Forming Step

The base particles forming step is appropriately selected depending on the intended purpose without any restriction, provided that it contains removing the organic solvent from the second fluid to form base particles.

A method for removing the organic solvent from the second fluid is appropriately selected depending on the intended purpose without any restriction, and examples thereof include a method in which the temperature of the second fluid is gradually increased to evaporate the organic solvent, and a method in which the second fluid is sprayed in a dry atmosphere to evaporate the organic solvent and the water.

The atmosphere for the drying is appropriately selected depending on the intended purpose without any restriction, and examples thereof include heated atmosphere of air, nitrogen, carbon dioxide, and combustion gas. The temperature of the heated atmosphere is preferably equal to or higher than the boiling points of the organic solvent for use and the water.

An apparatus used for spraying the second fluid in the dry atmosphere to evaporate the organic solvent and the water is appropriately selected depending on the intended purpose without any restriction, and examples thereof include a spray drier, a belt drier, a rotary kiln.

When the organic solvent is removed from the second fluid, a dispersion liquid in which the base particles are dispersed in the aqueous medium, or the base particles themselves are obtained.

The obtained dispersion liquid in which the base particles are dispersed in the aqueous medium or the obtained base particles are washed with water, and then are preferably subjected to vacuum drying. In such manner, any dispersant used can be removed.

The resulting base particles may be classified, if necessary.

The method for classifying the base particles is appropriately selected depending on the intended purpose without any restriction, and examples thereof include a method for removing fine particles by a cyclone, a decanter, or centrifugal separation, and a method for removing coarse particles using a mesh.

Base Particles-Spherical Silica Particles Mixing Step

The base particles-spherical silica particles mixing step is appropriately selected depending on the intended purpose without any restriction.

A mixing or stirring apparatus used for mixing the base particles and the spherical silica particles is appropriately selected depending on the intended purpose without any restriction, and examples thereof include HENSCHEL MIXER (manufactured by MITSUI MIKE MACHINERY Co., Ltd.), Super Mixer (manufactured by Kawata Corporation), Q Mixer (manufactured by Mitsui Mining Co., Ltd.), Mechanofusion System (manufactured by HOSOKAWA MICRON CORPORATION), and MECHANOMILL (manufactured by OKADA SEIKO CO., LTD.). Among them, a flow-stirring mixer is preferable.

In the case where the flow-stirring mixer is used with the condition that stirring is performed at the circumferential speed of 65 m/s to 120 m/s, the temperature T [° C.] for mixing the base particles and the spherical silica particles, and the onset temperature Ts [° C.] of the microcrystalline wax as determined by DSC preferably satisfy the following formula:

$$T \leq Ts - 20[^\circ\text{C.}] \quad (1)$$

Note that T [° C.] is a temperature of the inner wall of the flow-stirring mixer. When T and Ts do not satisfy the formula (1), part of the microcrystalline wax is bled out onto a surface of the base particle of the toner, and therefore the spherical silica particles may not be sufficiently fixed onto the base particle.

In the embodiments of the present invention, after mixing the base particles and the spherical silica particles, the particles may be further mixed with a charge controlling agent, a flow improver, an auxiliary cleaning agent, and the like.

A mixing or stirring device used for mixing with the charge controlling agent, the flow improver, the auxiliary cleaning agent, and the like is appropriately selected depending on the intended purpose without any restriction, and examples thereof include HENSCHEL MIXER (manufactured by MITSUI MIKE MACHINERY Co., Ltd.), Super Mixer (manufactured by Kawata Corporation), Q Mixer (manufactured by Mitsui Mining Co., Ltd.), Mechanofusion System (manufactured by HOSOKAWA MICRON CORPORATION), and MECHANOMILL (manufactured by OKADA SEIKO CO., LTD.).

Developer

The developer of the present invention contains the toner of the present invention.

The developer may be a one-component developer formed of the toner, or a two-component developer containing the toner and carrier. In the case where an image of a large imaging area is printed high speed, the two-component developer is preferably used.

Carrier

An amount of the carrier in the two-component developer is generally 90% by mass to 98% by mass, preferably 93% by mass to 97% by mass.

The carrier is preferably formed of a core coated with a resin layer.

A material for forming the core is appropriately selected depending on the intended purpose without any restriction, and examples thereof include a manganese-strontium based material of 50 emu/g to 90 emu/g, and a manganese-magnesium based material of 50 emu/g to 90 emu/g. These may be used independently, or in combination. Among them, high magnetic materials such as the iron of 100 emu/g or higher, and the magnetite of 75 emu/g to 120 emu/g are preferable for securing the desirable image density. Moreover, a weak magnetic material such as a copper-zinc based material of 30 emu/g to 80 emu/g is preferable because the resulting carrier enables to reduce the impact of the toner brush onto a photoconductor, and therefore it is advantageous for forming high quality images.

The volume average particle diameter of the core is appropriately selected depending on the intended purpose without any restriction, but it is generally 10 μm to 150 μm, preferably 40 μm to 100 μm. When the volume average particle diameter of the core is smaller than 10 μm, the magnetization per carrier particle is small, which may cause scattering of the carrier. When the volume average particle diameter thereof is larger than 150 μm, the specific area of the resulting particle of the carrier is small, which may cause scattering of the carrier.

A material for forming the resin layer is appropriately selected depending on the intended purpose without any restriction, and examples thereof include: amino resins such as a urea-formaldehyde resin, a melamine resin, a benzoguanamine resin, a urea resin, a polyemide resin, and an epoxy resin; polyvinyls such as an acrylic resin, methyl polymethacrylate, polyacrylonitrile, polyvinyl acetate, polyvinyl alcohol, and polyvinyl butyral; polystyrene resins such as polystyrene, a styrene-acryl copolymer; halogenated polyolefin; polyesters; polycarbonates such as polyvinyl chloride; polyesters such as polyethylene terephthalate, and polybutylene terephthalate; polyethylenes; fluororesins such as polyvinyl fluoride, polyvinylidene fluoride, polytrifluoroethylene, polyhexafluoropropylene, a vinylidene fluoride-acryl copolymer, a vinylidene fluoride-vinyl fluoride copolymer, and a copolymer of tetrafluoroethylene, vinylidene fluoride, and monomer containing no fluoro group; and silicone resins. These may be used independently, or in combination.

The resin layer may contain a conductive powder.

A material for forming the conductive powder is appropriately selected depending on the intended purpose without any restriction, and examples thereof include metals, carbon black, titanium oxide, tin oxide, and zinc oxide.

The average particle diameter of the conductive powder is appropriately selected depending on the intended purpose without any restriction, but it is generally 1 μM or smaller. When the average particle diameter of the conductive powder is larger than 1 μm, it may be difficult to control the electric resistance of the resin layer.

The resin layer can be formed, for example, by coating a surface of the core with a coating liquid in which the resin is dissolved in a solvent, drying and baking the coating liquid.

The solvent is appropriately selected depending on the intended purpose without any restriction, and examples thereof include toluene, xylene, methyl ethyl ketone, methyl isobutyl ketone, butyl acetate, and cellosolve.

The method for coating the coating liquid is appropriately selected depending on the intended purpose without any restriction, and examples thereof include dip coating, spray coating, and brush coating.

The method for baking is appropriately selected depending on the intended purpose without any restriction, and examples thereof include: external heating using an electric furnace, a rotary electric furnace, or a burner furnace; and internal heating using micro waves.

An amount of the resin layer in the carrier is appropriately selected depending on the intended purpose without any restriction, but it is generally 0.01% by mass to 5.0% by mass. When the amount of the resin layer in the carrier is less than 0.01% by mass, it may be difficult to form a uniform resin layer on the surface of the core. When the amount thereof is more than 5.0% by mass, the particles of the resulting carrier may cause aggregations.

Image Forming Method

The image forming method of the present invention contains: charging a photoconductor; exposing the charged photoconductor to light to form a latent electrostatic image; developing with the developer of the present invention the latent electrostatic image formed on the photoconductor to form a toner image; transferring the toner image formed on the photoconductor to a recording medium; and fixing the transferred toner image to the recording medium. The image forming method of the present invention preferably further contains cleaning the photoconductor from which the toner image has been transferred. Moreover, the image forming method of the present invention may further contain: diselectrifying the cleaned photoconductor; and recycling the developed collected from the photoconductor by the cleaning, if necessary.

Photoconductor

A shape of the photoconductor is appropriately selected depending on the intended purpose without any restriction, but the photoconductor is preferably in the shape of a drum.

Materials for forming the photoconductor are appropriately selected depending on the intended purpose without any restriction, and examples thereof include: inorganic compounds such as amorphous silicon, and selenium; and organic compounds such as polysilane, and phthalopolymetine. Among them, amorphous silicon is preferable, as it will give the resulting photoconductor a long service life.

Charging Step

The charging step is appropriately selected depending on the intended purpose without any restriction, as long as it contains charging the photoconductor. Examples thereof include applying voltage onto a surface of the photoconductor using a charging unit.

The charging unit is appropriately selected depending on the intended purpose without any restriction, and examples thereof include a contact charger having a conductive or semiconductive roller, brush, film, rubber blade, or the like; and a non-contact charger using corona discharge such as corotron and scorotron.

Latent Electrostatic Image Forming Step

The latent electrostatic image forming step is appropriately selected depending on the intended purpose without any restriction, provided that it contains exposing the charged photoconductor to light to form a latent electrostatic image.

Examples of the method for exposing the charged photoconductor to light include a method for applying light to a surface of the photoconductor using an exposure unit. The exposure of light may employ a backlight system in which light is applied to a back surface of the photoconductor.

The exposing unit is not particularly restricted, and examples thereof include various exposing devices such as a reproduction optical exposing device, a rod-lens array exposing device, a laser optical exposure device, and a liquid crystal shutter optical device.

Toner Image Forming Step

The toner image forming step is appropriately selected depending on the intended purpose without any restriction, provided that it contains developing with the developer of the present invention the latent electrostatic image formed on the photoconductor to form a toner image.

Examples of the method for developing the latent electrostatic image formed on the photoconductor with the developer of the present invention include a method for applying the toner of the present invention to the latent electrostatic image formed on the surface of the photoconductor using a developing unit.

The developing unit is appropriately selected depending on the intended purpose without any restriction, provided that it is capable of applying the toner of the present invention directly or indirectly to the latent electrostatic image formed on the photoconductor. Examples of the developing unit include a developing device containing a stirring unit configured to stir the developer of the present invention, which is a two-component developer, to apply a charge to the developer, and a rotatable magnetic roller. In the developing unit of the embodiment mentioned above, the developer of the present, which is charged in the stirring unit by frictions caused by stirring the toner of the present invention and the carrier, is held on a surface of the rotatable magnetic roller in the form of a brush to form a magnetic brush. Since the magnetic roller is provided adjacent to the photoconductor, part of the toner of the present invention forming the magnetic brush on the surface of the magnetic roller is applied to the latent electrostatic image formed on the surface of the photoconductor by static force. In the manner mentioned above, the latent electrostatic image formed on the photoconductor is developed with the developer of the present invention to thereby form a toner image.

Note that, the developer of the present invention housed in the developing device may be a one-component developer.

Transferring Step

The transferring step is appropriately selected depending on the intended purpose without any restriction, provided that it contains transferring the toner image formed on the photoconductor to a recording medium.

The method for transferring the toner image formed on the photoconductor to a recording medium is appropriately selected depending on the intended purpose without any restriction, and examples thereof include a method for transferring the toner image formed on the surface of the photoconductor to a surface of a recording medium using a transferring unit. In this method, it is preferred that the toner image formed on the surface of the photoconductor be transferred to an intermediate transferring member, and then transferred from the intermediate transferring member to a surface of a recording medium. Moreover, transferring of the toner image may be performed in the manner that toner images of different colors respectively formed on the surfaces of the photoconductors (subsequentially formed on the surface of the photoconductor) are transferred to the surface of the intermediate transferring member to form a composite toner image, and then the composite toner image formed on the surface of the intermediate transferring member is transferred to a surface of a recording medium.

The intermediate transferring member is appropriately selected depending on the intended purpose without any restriction, and examples thereof include an endless transfer belt.

The transferring unit is appropriately selected depending on the intended purpose without any restriction, and examples thereof include a corona transferring unit using corona discharge, a transferring belt, a transferring roller, a transferring pressure roller, and an adhesive transferring unit.

Note that, the recording medium is not particularly limited, and examples thereof include recording paper known in the art.

Fixing Step

The fixing step is appropriately selected depending on the intended purpose without any restriction, provided that it contains fixing the transferred toner image to the recording medium.

The method for fixing the transferred toner image to the recording medium is appropriately selected depending on the intended purpose without any restriction, and examples thereof include a method for fixing the transferred toner image to a surface of a recording medium using a fixing unit. In the case where a full-color image is formed, a toner image of each color may be fixed as soon as each toner image is transferred to a recording medium. Alternatively, fixing may be performed after all of the toner images are transferred to a recording medium.

The fixing unit is appropriately selected depending on the intended purpose without any restriction, and examples thereof include a unit combining a heating roller and a compressing roller, and a unit combining a heating roller, a compressing roller, and an endless belt. The temperature for the heating roller for fixing is generally 80° C. to 200° C. Note that, in combination with or instead of the fixing unit, a optical fixing unit known in the art may be used.

Cleaning Step

The cleaning step is appropriately selected depending on the intended purpose without any restriction, provided that it contains cleaning the photoconductor from which the toner image has been transferred.

Examples of the method for cleaning the photoconductor include a method of removing the residual toner remained on the surface of the photoconductor using a cleaning unit.

The cleaning unit is appropriately selected depending on the intended purpose without any restriction provided that it can remove the residual toner remained on a surface of the photoconductor, and examples thereof include a magnetic brush cleaner, an electrostatic brush cleaner, a magnetic roller cleaner, a blade cleaner, a brush cleaner, and a web cleaner.

Diselectrification Step

The diselectrification step is appropriately selected depending on the intended purpose without any restriction, provided that diselectrifying the cleaned photoconductor.

Examples of the method for diselectrifying the photoconductor include a method of applying a diselectrification bias to the surface of the photoconductor using a diselectrification unit, to thereby diselectrify the photoconductor.

The diselectrification unit is not particularly limited, as long as it is capable of applying a diselectrification bias to the surface of the photoconductor, and examples thereof include a diselectrification lamp.

Recycling Step

The recycling step is appropriately selected depending on the intended purpose without any restriction, provided that it contains recycling the developed collected from the photoconductor by the cleaning.

Examples of the method for recycling the collected developer include a method of sending the collected toner to the developing unit using a recycling unit.

The recycling unit is appropriately selected depending on the intended purpose without any restriction, and examples thereof include a conveying unit known in the art.

Controlling Unit

Each unit (i.e. each device) can be controlled using a controlling unit.

The controlling unit is appropriately selected depending on the intended purpose without any restriction provided that it is capable of controlling operations of each unit (i.e. each device), and examples thereof include a sequencer, and a computer.

One example of the image forming apparatus used in the present invention is illustrated in FIG. 1. An image forming apparatus 100A is equipped with a photoconductor drum 10 (hereafter referred to as "photoconductor 10"), a charge roller 20, an exposure device (not shown), a developing device 40, an intermediate transfer belt 50, a cleaning device 60 having a cleaning blade, and a charge eliminating lamp 70.

The intermediate transfer belt 50 is stretched around three rollers 51 placed inside the belt and designed to be moveable in arrow direction. Part of the three rollers 51 function as a transfer bias roller capable of applying a transfer bias (primary transfer bias), to the intermediate transfer belt 50.

A cleaning unit containing a cleaning blade 90 is placed near the intermediate transfer belt 50. A transfer roller 80, which is capable of applying a transfer bias (secondary transfer bias) for transferring a toner image onto a recording paper P, is placed so as to face to the intermediate transfer belt 50.

In the surrounding area of the intermediate transfer belt 50, a corona charger 52 for supplying an electrical charge to the toner image on the intermediate transfer belt 50 is placed between contact area of the photoconductor 10 and the intermediate transfer belt 50, and contact area of the intermediate transfer belt 50 and recording paper P in the rotational direction of the intermediate transfer belt 50.

The developing device 40 of each color of black (K), yellow (Y), magenta (M), and cyan (C) is equipped with a developer storage container 41, a developer feeding roller 42, and a developing roller 43.

In the image forming apparatus 100A, a surface of the photoconductor 10 is uniformly charged using the charging roller 20, and exposure light L is exposed to the photoconductor 10 using the exposure device (not shown) to form a latent electrostatic image. Next, the latent electrostatic image formed on the photoconductor 10 is then developed with the toner fed from the developing device 40 to form a toner image. The toner image formed on the photoconductor 10 is transferred (primary transfer) onto the intermediate transfer belt 50 by a voltage applied from the roller 51. Moreover, charge is applied to the toner image on the intermediate transfer belt 50 by a corona charger 52, and the toner image is transferred onto the recording medium P (secondary transfer). The toner remained on the photoconductor 10 is then removed by the cleaning device 60, and the charge built up over the photoconductor 10 is temporarily removed by the charge eliminating lamp 70.

Figure 2:
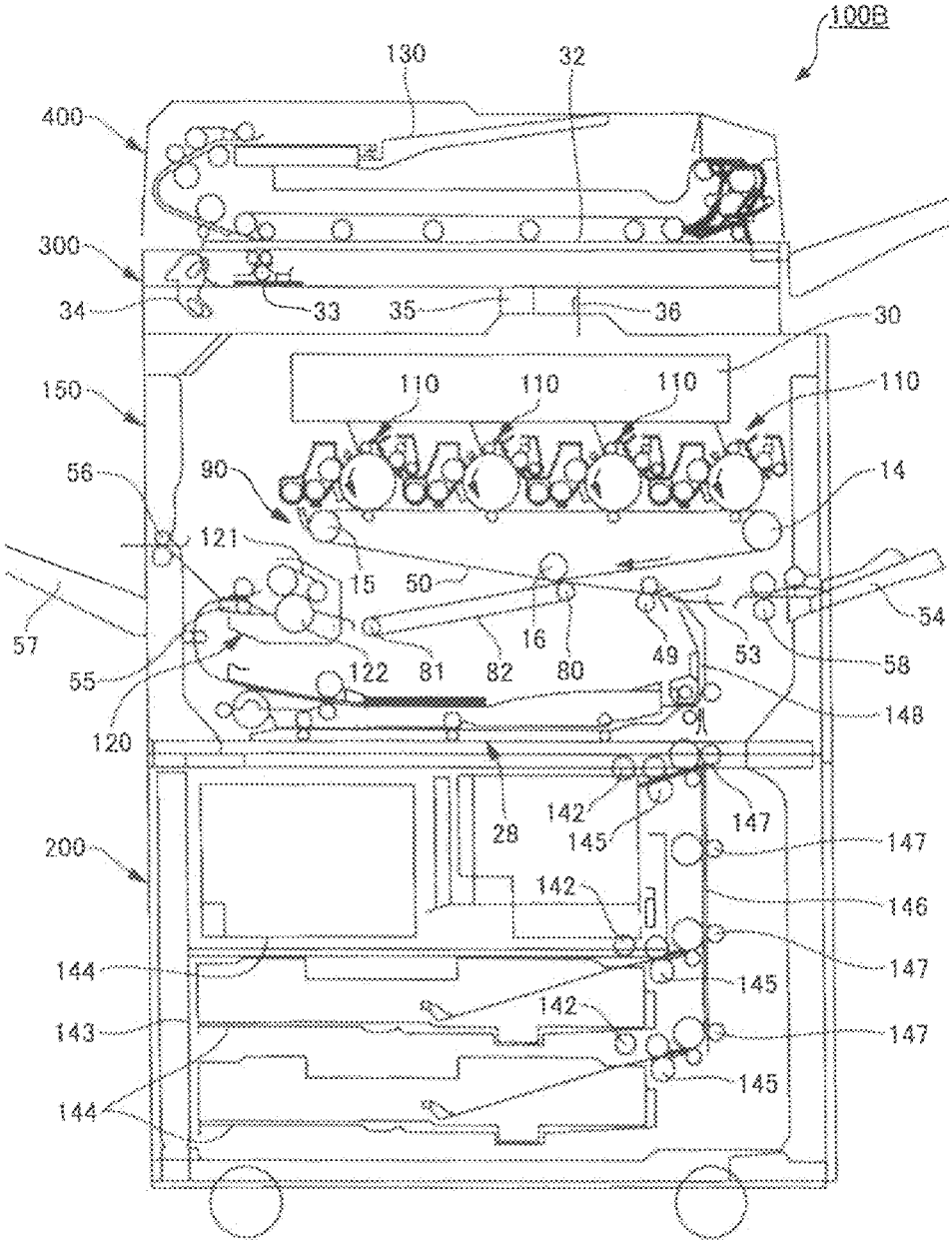
FIG. 2 is a diagram illustrating another example of an image forming apparatus used in the present invention.

Another example of the image forming apparatus used in the present invention is illustrated in FIG. 2. The image forming apparatus 100B is a tandem-type color image forming apparatus, and contains a copying machine main body 150, a paper feeder table 200, a scanner 300, and an automatic document feeder (ADF) 400.

To the copying machine main body 150, an intermediate transfer belt 50 is provided at the center part thereof. The intermediate transfer belt 50 is stretched around three rollers 14, 15, and 16 and is configured to rotate in the direction shown with the arrow.

Figure 3:
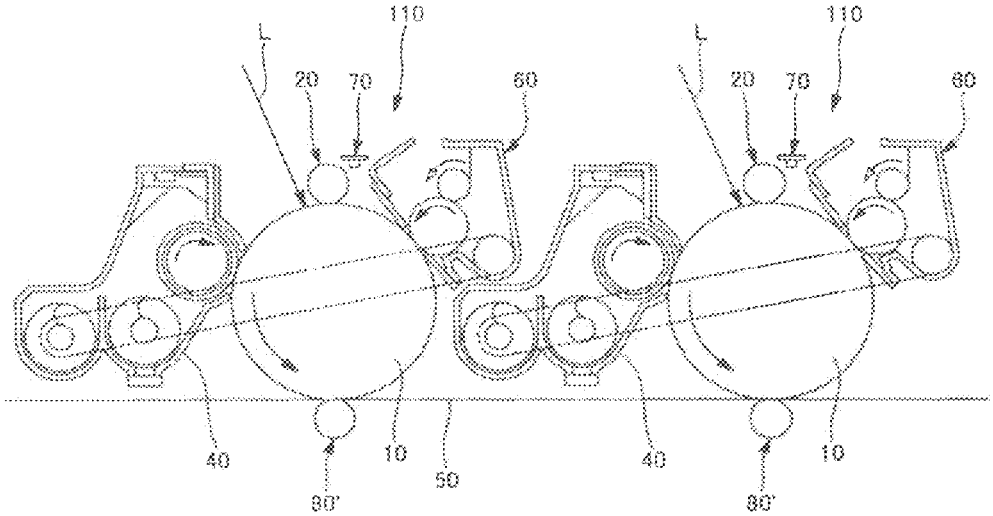
FIG. 3 is a diagram illustrating an image forming unit of the image forming apparatus of FIG. 2.

A cleaning device 90 having a cleaning blade is provided adjacent to the roller 15. Moreover, four image forming units 110 including of yellow, cyan, magenta, and black are provided along with the rotational direction of the intermediate transfer belt 50. The image forming unit 110 of each color is, as illustrated in FIG. 3, equipped with a photoconductor drum 10, a charging roller 20 for uniformly charging the photoconductor drum 10, a developing device 40 for developing a latent electrostatic image formed on the photoconductor drum 10 with a developer of each color of black (K), yellow (Y), magenta (M), and cyan (C) to form a toner image, a transfer roller 80' for transferring the toner image of each color onto an intermediate transfer belt 50, a cleaning device 60, and a charge-eliminating lamp 70.

Moreover, the exposing device 30 is provided adjacent to the image forming unit 110. The exposing device 30 applys exposure light L onto the photoconductor drum 10 to form a latent electrostatic image thereon.

Moreover, a transfer roller 80 is provided to as to face the roller 16 at the side of the intermediate transfer belt 50 opposite to the side thereof where the image forming unit 110 is provided. A conveyer belt 82 for conveying the recording medium is stretched around the transfer roller 80 and a support roller 81, so that the recording medium and the intermediate transfer belt 50 can be in contact to each other.

A fixing device 120 is provided adjacent to the conveyer belt 82. The fixing device 120 is equipped with a fixing belt 121, and a compressing roller 122 provided so as to press against the fixing belt 121.

Furthermore, a sheet reverser 28 for reversing the recording medium for forming images on the both sides of the medium is provided near the conveying belt 82 and the fixing device 120.

Formation of a full-color image (color copy) by the image forming apparatus 100B will be explained next. Initially, a document is placed on a document platen 130 of the automatic document feeder (ADF) 400. Alternatively, the automatic document feeder 400 is opened, a document is placed on a contact glass 32 of the scanner 300, and the automatic document feeder 400 is closed. At the time when a start switch (not shown) is pushed, the document placed on the document platen 130 is transported onto the contact glass 32, and then the document is scanned with a first carriage 33 and a second carriage 34. In the case where the document is initially placed on the contact glass 32, the scanner 300 is immediately driven to operate the first carriage 33 equipped and the second carriage 34 equipped. Light is applied from a light source of the first carriage 33 to the document, and reflected light from the document is further reflected at a mirror of the second carriage 34. Then, the light reflected at the mirror passes through an image forming lens 35 to reach a read sensor 36. In the manner as mentioned, the color document (color image) is read, and image information of each color of black, yellow, magenta, and cyan is obtained.

After forming a latent electrostatic image of each color on the photoconductor 10 by means of the exposing device 30 based on the obtained image information of each color, the latent electrostatic image of each color is developed with a developer supplied from the developing device 40 of respective color to thereby form a toner image of each color. The formed toner images of respective colors are sequentially transferred (primary transfer) to the intermediate transfer belt 50 that is rotated by rollers 14, 15, and 16 to thereby form a composite toner image.

One of feeding rollers 142 of the feeder table 200 is selectively rotated, a recording medium is ejected from one of multiple feeder cassettes 144 in a paper bank 143 and are separated by a separation roller 145 one by one into a feeder path 146, are transported by a transport roller 147 into a feeder path 148 and are bumped against a registration roller 49 to stop Alternatively, recording paper is ejected recording paper from a manual-feeding tray 54, and separated by a separation roller 58 one by one into a feeder path 53, transported one by one and then bumped against the registration roller 49. Note that, the resist roller 49 is generally earthed, but it may be biased for removing paper dust of the recording paper.

The registration roller 49 is rotated synchronously with the movement of the composite color image on the intermediate transfer belt 50 to transport the recording paper into between the intermediate transfer belt 50 and the conveying belt 82, and the composite toner image is transferred (secondary transferred) onto the recording medium.

The recording paper onto which the composite toner image has been transferred is conveyed by the conveying belt 82 to introduce into a fixing device 120. In the fixing device 120, the composite toner image is heated and compressed by a fixing belt 121 and a compressing roller 122 to fix onto the recording medium. Thereafter, the recording medium changes its traveling direction by action of a switch blade 55, is ejected by an ejecting roller 56 and is stacked on an output tray 57. Alternatively, the recording medium is changed its traveling direction by action of the switch blade 55, and reversed by the sheet reverser 28, and subjected to an image formation on the back surface thereof. The recording medium bearing images on both sides thereof is then ejected with assistance of the ejecting roller 56, and is stacked on the output tray 57.

The toner remained on the intermediate transfer belt 50 after the composite toner image is transferred is removed by the cleaning device 90.

The ranges described above in the detailed description of the invention section include all specific values and subranges therebetween.

EXAMPLE

The present invention will be more concretely explained through examples thereof hereinafter, but these examples shall not be construed as limiting the scope of the present invention in any way. In the following descriptions, "part(s)" denotes "part(s) by mass."

Production Example 1

Synthesis of Polyester A

A reaction vessel equipped with a cooling tube, a stirrer, and a nitrogen gas inlet tube was charged with 67 parts of bisphenol A ethylene oxide (2 mol) adduct, 84 parts of bisphenol A propyleneoxide (3 mol) adduct, 274 parts of terephthalic acid, and 2 parts of dibutyltin oxide, and the mixture was allowed to react at 230° C. for 10 hours under normal pressure. Then, the reaction mixture was further reacted under reduced pressure of 10 mmHg to 15 mmHg for 6 hours to thereby obtain Polyester A. Polyester A had a number average molecular weight of 2,300, weight average molecular weight of 7,000, glass transition temperature of 65° C., acid value of 20 mgKOH/g, and hydroxyl value of 40 mgKOH/g.

Production Example 2

Synthesis of Polyester B

A reaction vessel equipped with a cooling tube, a stirrer, and a nitrogen gas inlet tube was charged with 77 parts of bisphenol A ethylene oxide (2 mol) adduct, 74 parts of bisphenol A propyleneoxide (3 mol) adduct, 289 parts of terephthalic acid, and 2 parts of dibutyltin oxide, and the mixture was allowed to react at 230° C. for 8 hours under normal pressure. Then, the reaction mixture was further reacted under reduced pressure of 10 mmHg to 15 mmHg for 5 hours to thereby obtain Polyester B. Polyester B had a number average molecular weight of 2,100, weight average molecular weight of 5,600, glass transition temperature of 62° C., acid value of 35 mgKOH/g, and hydroxyl value of 95 mgKOH/g.

Production Example 3

Preparation of Master Batch

By means of HENSCHEL MIXER (manufactured by Mitsui Mining Co., Ltd.), 1,000 parts of water, 540 parts of carbon black (PRINTEX 35, manufactured by Degussa Co., DBP oil absorption=42 mL/100 g, pH=9.5), and 1,200 parts of Polyester A were mixed. The obtained mixture was kneaded at 150° C. for 30 minutes by means of a two-roll kneader, and the resultant was rolled and cooled, followed by pulverized by means of a pulverizer (manufactured by Hosokawa Micron Corporation) to thereby yield a master batch.

Production Example 4

Synthesis of Polyester Prepolymer

A reaction vessel equipped with a cooling tube, a stirrer, and a nitrogen gas inlet tube was charged with 682 parts of bisphenol A ethylene oxide (2 mol) adduct, 81 parts of bisphenol A propyleneoxide (2 mol) adduct, 283 parts of terephthalic acid, 22 parts of trimellitic anhydride and 2 parts of dibutyltin oxide, and the mixture was allowed to react for 8 hours at 230° C. under normal pressure, followed by reacting for 5 hours under the reduced pressure of 10 mHg to 15 mHg, to thereby obtain intermediate polyester. The intermediate polyester had a number average molecular weight of 2,100, weight average molecular weight of 9,500, glass transition temperature of 55° C., acid value of 0.5 mgKOH/g, and hydroxyl value of 51 mgKOH/g.

Next, a reaction vessel equipped with a cooling tube, a stirrer, and a nitrogen gas inlet tube was charged with 410 parts of the intermediate polyester, 89 parts of isophorone diisocyanate, and 500 parts of ethyl acetate, and the mixture was allowed to react at 100° C. for 5 hours to thereby obtain polyester prepolymer. An amount of the free isocyanate groups in the polyester prepolymer was 1.53% by mass.

Production Example 5

Synthesis of Ketimine

A reaction vessel equipped with a stirring bar and a thermometer was charged with 170 parts of isophorone diamine, and 75 parts of methyl ethyl ketone, and the mixture was allowed to react at 50° C. for 5 hours to thereby obtain ketimine. The obtained ketimine had the amine number of 418 mgKOH/g.

Production Example 6

Preparation of Aqueous Medium

A reaction vessel equipped with a stirring bar, and a thermometer was charged with 683 parts of water, 11 parts of a sodium salt of sulfate ester of methacrylic acid ethylene oxide adduct, ELEMINOL RS-30 (manufactured by Sanyo Chemical Industries, Ltd.), 83 parts of styrene, 83 parts of methacrylic acid, 110 parts of butyl acrylate, and 1 part of ammonium persulfate. After stirring the mixture at 400 rpm for 15 minutes, the mixture was heated to 75° C., and allowed to react for 5 hours. To the resulting reaction mixture, 30 parts of 1% by mass ammonium perfulfate aqueous solution was added, and the solution was then matured at 75° C. for 5 hours, to thereby obtain a dispersion liquid of vinyl resin particles. The volume average particle diameter of vinyl resin particles in the dispersion liquid was measured by means of Nanotrack Particle Size Analyzer UPA-EX150 (manufactured by NIKKISO CO., LTD.) and it was 45 nm. In addition, part of the dispersion liquid of the vinyl resin particles was dried to separate the resin component, and a glass transition temperature and weight average molecular weight of the resin component were measured. The results were 59° C. and 150,000, respectively.

An aqueous medium was obtained by mixing and stirring 990 parts of water, 83 parts of the dispersion liquid of vinyl resin particles, 37 parts of ELEMINOL MON-7 (48.5% by mass sodium dodecyldiphenyl ether sulfonate aqueous solution, manufactured by Sanyo Chemical Industries, Ltd.), 135 parts of CELLOGEN BS-H-3 (1% by mass sodium carboxymethyl cellulose aqueous solution, manufactured by Dai-ichi Kogyo Keiyaku Co., Ltd.), and 90 parts of ethyl acetate.

Example 1

A reaction vessel equipped with a stirring bar and a thermometer was charged with 364 parts of Polyester B, 124 parts of microcrystalline wax HiMic-0086 (manufactured by Nippon Seiro Co., Ltd., the onset temperature as determined by DSC: 55° C., peak temperature as determined by DSC: 79° C., carbon number distribution: 25 to 55), and 947 parts of ethyl acetate, and the mixture was heated to 80° C. with stirring, and the temperature was maintained at 80° C. for 5 hours. Then, the mixture was cooled 30° C. over 1 hour. Next, the reaction vessel was charged with 500 parts of the master batch, and 500 parts of ethyl acetate, and the mixture was mixed for 1 hour to thereby obtain a liquid mixture.

The obtained liquid mixture (1,324 parts) was transferred to a reaction vessel, and passed through a bead mill, ULTRAVISCOMILL (manufactured by AIMEX CO., Ltd.), 80% by volume of which was filled with zirconium beads each having a particle diameter of 0.5 mm, three times under the conditions that the liquid feeding speed of 1 kg/h, and disk circumferential speed of 6 m/s, to thereby obtain a dispersion liquid.

To obtained dispersion liquid, 1,324 parts of a 65% by mass ethyl acetate solution of Polyester B, the resulting liquid was passed through ULTRAVISCOMILL once under the same conditions as mentioned above, to thereby obtain a dispersion liquid.

To 200 parts of the obtained dispersion liquid, 1.5 parts of modified layered inorganic mineral (CLAYTONE APA, manufactured by Southern Clay Products) was added, the mixture was dispersed by means of T.K. HOMO DISPER (manufactured by PRIMIX Corporation) at 7,000 rpm for 60 minutes to thereby obtain a dispersion liquid.

A reaction vessel was charged with 749 parts of the obtained dispersion liquid, 115 parts of the polyester prepolymer obtained in Production Example 4, and 2.9 parts of ketimine obtained in Production Example 5, and the mixture was stirrer by means of T.K. HOMO MIXER (manufactured by PRIMIX Corporation) at 5,000 rpm for 1 minute to thereby obtain a dispersion liquid of a toner material.

To 1,200 parts of the aqueous medium obtained in Production Example 6, 867 parts of the dispersion liquid of the toner material was added, and the mixture was stirred by means of T.K. HOMO MIXER at 13,000 rpm for 20 minutes to thereby obtain emulsion slurry.

Next, a reaction vessel equipped with a stirrer and a thermometer was charged with the emulsion slurry, and the solvent was removed from the emulsion slurry at 30° C. over 8 hours, followed by maturing at 45° C. for 4 hours, to thereby obtain dispersion slurry.

A particle size distribution of the dispersion slurry was measured by MULTISIZER III (manufactured by Beckman Coulter, Inc.), and it was found that a volume average particle diameter, and number average particle diameter of the dispersion slurry were 5.1 μm, and 4.9 μm, respectively.

The dispersion slurry (100 parts) was subjected to vacuum filtration, and to the resulting filtration cake 100 parts of ion-exchanged water was added. The resulting mixture was stirred by means of T.K. HOMO MIXER at 12,000 rpm for 10 minutes, followed by subjecting to filtration. To the resulting filtration cake, a 10% by mass phosphoric acid solution was added to adjust the pH to 3.7, and the resultant was stirred by means of T.K. HOMO MIXER at 12,000 rpm for 10 minutes. Then, the resulting mixture was subjected to filtration. To the obtained filtration cake, 300 parts of ion-exchanged water was added, and the mixture was stirred by means of T.K. HOMO MIXER at 12,000 rpm for 10 minutes, followed by subjecting to filtration. This operation was performed twice, to thereby obtain a filtration cake. The obtained filtration cake was dried by means of a hot air circulating drying oven at 45° C. for 48 hours, followed by sieving through a mesh having an opening of 75 μm, to thereby obtain base particles.

The obtained base particles (100 parts) and spherical silica particles (1 part) (manufactured by Tokuyama Corporation) having the average primary particle diameter of 130 nm were mixed by stirring by means of Q Mixer (manufactured by Mitsui Mining Co., Ltd.), which was a flow-stirring mixer, at the temperature of 30° C., and the circumferential speed of 100 m/s. To the resulting mixture, 1 part of hydrophobic silica having the average primary particle diameter of 20 nm (HDK-2000, manufactured by Wacker Asahikasei Silicone Co., Ltd.), and 0.7 parts of hydrophobic titanium oxide having the average primary particle diameter of 20 nm were added, and the mixture was stirred by means of HENSCHEL MIXER (manufactured by Mitsui Mining Co., Ltd.) to thereby obtain a toner.

Example 2

A toner was obtained in the same manner as in Example 1, provided that 100 parts of the base particles, and 1 part of spherical silica particles having the average primary particle diameter of 130 nm (manufactured by Tokuyama Corporation) were stirred by Q Mixer (manufactured by Mitsui Mining Co., Ltd.), which was a flow-stirring mixer, at 35° C. for mixing.

Example 3

A toner was obtained in the same manner as in Example 1, provided that 100 parts of the base particles, and 1 part of spherical silica particles having the average primary particle diameter of 130 nm (manufactured by Tokuyama Corporation) were stirred by Q Mixer (manufactured by Mitsui Mining Co., Ltd.), which was a flow-stirring mixer, at 45° C. for mixing.

Comparative Example 1

A toner was obtained in the same manner as in Example 1, provided that instead of mixing 100 parts of the base particles and 1 part of the spherical silica particles having the average primary particle diameter of 130 nm (manufactured by Tokuyama Corporation), 100 parts of the base particles, 1.5 parts of hydrophobic silica having the average primary particle diameter of 20 nm (HDK-2000, manufactured by Wacker Asahikasei Silicone Co., Ltd.), and 0.7 parts of hydrophobic titanium oxide having the average primary particle diameter of 20 nm were mixed by means of HENSCHEL MIXER (manufactured by Mitsui Mining Co., Ltd.).

Comparative Example 2

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with microcrystalline wax BSQ180 W (manufactured by Baker Petrolite, the onset temperature as determined by DSC: 45° C., peak temperature as determined by DSC: 80° C., carbon number distribution: 20 to 60).

Example 4

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with purified microcrystalline wax BSQ180 W (manufactured by Baker Petrolite, the onset temperature as determined by DSC: 48° C., peak temperature as determined by DSC: 82° C., carbon number distribution: 27 to 54).

Example 5

A toner was obtained in the same manner as in Example 4, provided that 100 parts of the base particles, and 1 part of spherical silica particles having the average primary particle diameter of 130 nm (manufactured by Tokuyama Corporation) were stirred by Q Mixer (manufactured by Mitsui Mining Co., Ltd.), which was a flow-stirring mixer, at 25° C. for mixing.

Comparative Example 3

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with microcrystalline wax HiMic-1080 (manufactured by Nippon Seiro Co., Ltd., the onset temperature as determined by DSC: 42° C., peak temperature as determined by DSC: 61° C., carbon number distribution: 20 to 55), and 100 parts of the base particles and 1 part of the spherical silica particles having the average primary particle diameter of 130 nm (manufactured by Tokuyama Corporation) were mixed by means of Q Mixer (manufactured by Mitsui Mining Co., Ltd.), which was a flow-stirring mixer, at 25° C.

Example 6

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with purified microcrystalline wax HiMic-1080 (manufactured by Nippon Seiro Co., Ltd., the onset temperature as determined by DSC: 46° C., peak temperature as determined by DSC: 67° C., carbon number distribution: 26 to 53), and 100 parts of the base particles and 1 part of the spherical silica particles having the average primary particle diameter of 130 nm (manufactured by Tokuyama Corporation) were mixed by means of Q Mixer (manufactured by Mitsui Mining Co., Ltd.), which was a flow-stirring mixer, at 25° C.

Example 7

A toner was obtained in the same manner as in Example 1, provided that 100 parts of the base particles, and 1 part of the spherical silica particles having the average primary particle diameter of 130 nm (manufactured by Tokuyama Corporation) were stirred by means of a mixer (manufactured by Mitsui Mining Co., Ltd.), which was a flow-stirring mixer, at the circumferential speed of 65 m/s for mixing.

Example 8

A toner was obtained in the same manner as in Example 1, provided that instead of the spherical silica having the average primary particle diameter of 130 nm (manufactured by Tokuyama Corporation), 1 part of spherical silica particles having the average primary particle diameter of 100 nm (manufactured by Shin-Etsu Chemical Co., Ltd.) was used.

Example 9

A toner was obtained in the same manner as in Example 1, provided that the spherical silica particles having the average primary particle diameter of 130 nm (manufactured by Tokuyama Corporation) was replaced with spherical silica particles having the average primary particle diameter of 150 nm (manufactured by Tokuyama Corporation).

Example 10

A toner was obtained in the same manner as in Example 1, provided that 100 parts of the base particles and 1 part of the spherical silica particles having the average primary particle diameter of 130 nm (manufactured by Tokuyama Corporation) were mixed by means of HENSCHEL MIXER (manufactured by Mitsui Mining Co., Ltd.).

Comparative Example 4

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with purified microcrystalline wax BSQ180 W (manufactured by Baker Petrolite, the onset temperature as determined by DSC: 55° C., carbon number distribution: 25 to 58), and CLAYTONE APA (manufactured by Southern Clay Products) was not added.

Comparative Example 5

A toner was obtained in the same manner as in Example 1, provided that the microcrystalline wax HiMic-0086 (manufactured by Nippon Seiro Co., Ltd., the onset temperature as determined by DSC: 55° C., peak temperature as determined by DSC: 79° C., carbon number distribution: 25 to 55) was replaced with paraffin wax HNP-11 (manufactured by Nippon Seiro Co., Ltd., the onset temperature as determined by DSC: 57° C., peak temperature as determined by DSC: 70° C., carbon number distribution: 28 to 40), and 100 parts of the base particles, and 1 part of the spherical silica particles having the average primary particle diameter of 130 nm (manufactured by Tokuyama Corporation) were mixed by Q Mixer (manufactured by Mitsui Mining Co., Ltd.), which was a flow-stirring mixer, at 35° C.

The conditions for producing the toner are shown in Table 1.

TABLE 1

| | | | | Average primary particle diameter [nm] | | | |
|---|---|---|---|---|---|---|---|
| | Wax | Carbon distribution of wax | Ts [° C.] | Spherical silica particles | Hydrophobic silica particles | T [° C.] | Circumferential speed |
| Ex. 1 | Microcrystalline wax | 25-55 | 55 | 130 | 20 | 30 | 100 |
| Ex. 2 | Microcrystalline wax | 25-55 | 55 | 130 | 20 | 35 | 100 |
| Ex. 3 | Microcrystalline wax | 25-55 | 55 | 130 | 20 | 45 | 100 |
| Ex. 4 | Microcrystalline wax | 27-54 | 48 | 130 | 20 | 30 | 100 |
| Ex. 5 | Microcrystalline wax | 27-54 | 48 | 130 | 20 | 25 | 100 |
| Ex. 6 | Microcrystalline wax | 26-53 | 46 | 130 | 20 | 25 | 100 |
| Ex. 7 | Microcrystalline wax | 25-55 | 55 | 130 | 20 | 30 | 65 |
| Ex. 8 | Microcrystalline wax | 25-55 | 55 | 100 | 20 | 30 | 100 |
| Ex. 9 | Microcrystalline wax | 25-55 | 55 | 150 | 20 | 30 | 100 |
| Ex. 10 | Microcrystalline wax | 25-55 | 55 | 130 | 20 | — | — |
| Comp. Ex. 1 | Microcrystalline wax | 25-55 | 55 | — | 20 | — | — |
| Comp. Ex. 2 | Microcrystalline wax | 20-60 | 45 | 130 | 20 | 30 | 100 |
| Comp. Ex. 3 | Microcrystalline wax | 20-55 | 42 | 130 | 20 | 25 | 100 |
| Comp. Ex. 4 | Microcrystalline wax | 25-58 | 55 | 130 | 20 | 30 | 100 |
| Comp. Ex. 5 | Paraffin wax | 28-40 | 57 | 130 | 20 | 35 | 100 |

Note that, Ts and T respectively represents an onset temperature of the wax as determined by DSC, and temperature of an inner wall of Q Mixer (manufactured by Mitsui Mining Co., Ltd.), which is a flow-stirring mixer, when the base particles and the spherical silica particles are mixed. Moreover, the circumferential speed is a circumferential speed when the stirring is performed by means of Q Mixer (manufactured by Mitsui Mining Co., Ltd.).

Onset Temperature of Wax Determined by DSC

Thermal properties of the wax were determined by means of DSC-60 (manufactured by Shimadzu Corporation) under the nitrogen atmosphere at the temperature increasing rate of 10° C./min. Next, an onset temperature on a DSC curve at the first time of the elevation of the temperature was determined using an analysis program in the DSC-60 system.

Carbon Number Distribution of Wax

The carbon number distribution of the wax was measured using a total ion current chromatogram.

The properties of the toner are shown in Table 2.

TABLE 2

| | Average circularity | Free-particle rate of silica particles [% by mass] | Amount of spherical silica particles in free silica particles [% by volume] |
|---|---|---|---|
| Ex. 1 | 0.966 | 21 | 25 |
| Ex. 2 | 0.966 | 23 | 38 |
| Ex. 3 | 0.966 | 28 | 45 |
| Ex. 4 | 0.964 | 25 | 35 |
| Ex. 5 | 0.965 | 20 | 22 |
| Ex. 6 | 0.966 | 20 | 20 |
| Ex. 7 | 0.966 | 30 | 50 |
| Ex. 8 | 0.966 | 17 | 21 |
| Ex. 9 | 0.966 | 29 | 50 |
| Ex. 10 | 0.966 | 35 | 60 |
| Comp. Ex. 1 | 0.966 | 15 | — |
| Comp. Ex. 2 | 0.965 | 27 | 55 |
| Comp. Ex. 3 | 0.966 | 32 | 58 |
| Comp. Ex. 4 | 0.975 | 28 | 55 |
| Comp. Ex. 5 | 0.965 | 32 | 65 |

Average Circularity

The average circularity of the particles having particle diameters of 2 μm to 400 μm was measured by means of FPIA-3000 (manufactured by Sysmex Corporation).

Free Particle Rate of Silica Particles, and Amount of Spherical Silica Particles within Free Silica Particles A dispersion liquid in which 4 g of the toner was dispersed in about 150 mL of ion-exchanged water with assistance of 1% by mass of a nonionic surfactant (NIOGEN, manufactured by Dai-ichi Kogyo Keiyaku Co., Ltd.) was dispersed by means of a ultrasonic homogenizer VCX750 (manufactured by Sonics & Materials, Inc.) for 2 minutes at an output power of 30 W to 50 W. Thereafter, the resulting dispersion liquid was subjected to centrifugal separation by means of a centrifuge H-38F (manufactured by KOKUSAN Co., Ltd.) at 3,000 rpm for 2 minutes.

The supernatant liquid obtained by the centrifugal separation was isolated, and the residue was subjected to suction filtration, followed by drying. The dried residue was analyzed by means of an X-ray fluorescence spectroscopy ZSX100e (manufactured by Rigaku Corporation) to thereby calculate a silica content CI in the residue. In the same manner as mentioned, a silica content Co in the toner before centrifugal separation was calculated, and a free particle rate of the silica particles was calculated based on the following formula:

$$(C_0-C_1)/C_0\times 100[\%\text{ by mass}]$$

To the supernatant liquid obtained by the centrifugal separation, 1% by mass of a nonionic surfactant (NIOGEN, manufactured by Dai-ichi Kogyo Keiyaku Co., Ltd.) was added, and the resultant was dispersed by means of a ultrasonic homogenizer VCX750 (manufactured by Sonics & Materials, Inc.) for 2 minutes at an output power of 30 W to 50 W. Thereafter, by means of a laser diffraction/scattering particle size analyzer LA-920 (manufactured by HORIBA, Ltd.), the particle size distribution was measured to thereby obtain an amount (% by volume) of the particles having particle diameters of 100 nm to 150 nm, which was determined as an amount of the spherical silica particles in the free silica particles.

Preparation of Carrier

A coating liquid was obtained by dispersing 21 parts of a 50% by mass acrylic resin solution, 6.4 parts of a 70% by mass guanamine solution, 7.6 parts of alumina particles having the average primary particle diameter of 0.3 μm and volume resistivity of $1\times10^{14}$ Ω·cm, 65 parts of a 23% by mass silicone resin solution SR2410 (manufactured by Dow Corning Toray Co., Ltd.), 0.3 parts of aminosilane SH6020 (manufactured by Dow Corning Toray Co., Ltd.), 60 parts of toluene, and 60 parts of butyl cellosolve by means of a homomixer for 10 minutes. The obtained coating liquid was applied to each surface of a fired ferrite powder $(MgO)_{1.8}(MnO)_{49.5}(Fe_2O_3)_{48.0}$ having the average primary particle diameter of 50 μm by means of SPIRA COTA (manufactured by OKADA SEIKO CO., LTD.) to have a film thickness of 0.15 μm, and the coated film was dried. Then, the resultant was baked in an electric furnace at 150° C. for 1 hour, followed by cooling, and sieving through a sieve having an opening of 106 μm, to thereby obtain a carrier.

Preparation of Developer

A developer was obtained by stirring 6 parts of the toner and 94 parts of the carrier by means of TURBULA MIXER T2F (manufactured by Willy A. Bachofen AG Maschinenfabrik) for 5 minutes.

The obtained developer was evaluated in terms of its lowest fixing temperature, cleaning ability, silica deposition, and device contamination.

Lowest Fixing Temperature

Using a modified device of Digital Color Imagio Neo C600 (manufactured by Ricoh Company Limited), the lowest fixing temperature of the developer was evaluated while lowering the setting of the fixing temperature from 120° C. by 5° C. Note that, the lowest fixing temperature was the temperature at which the smear ID was 0.4 or lower.

Cleaning Ability

After forming an image having the imaging area rate of 100% on an A3 sheet using a modified device of Digital Color Imagio MP C7500 (manufactured by Ricoh Company Limited) under the environment of 10° C., 15% RH, the A3 sheets were passed through, and then the cleaning ability was evaluated. Note that, the cleaning ability was determined as: A, in the case where no cleaning failure occurred until 200,000 sheets were fed; B, in the case where no cleaning failure occurred until 100,000 sheets were fed; C, in the case where no cleaning failure occurred until 50,000 sheets were fed; and D, in the case where a cleaning failure occurred when less than 50,000 sheets were fed.

Depositions of Silica Particles

Using a modified device of Digital Color Imagio MP C7500 (manufactured by Ricoh Company Limited), an image chart having an imaging area rate of 50% was output on 100,000 sheets at monocolor mode. Thereafter, depositions of silica particles on the photoconductor were visually observed, and evaluated. The case where no silica particle was deposited on the photoconductor was evaluated as B; the case where a slight amount of the silica particles was deposited on the photoconductor was evaluated as C; the case where the silica particles were deposited on the entire surface of the photoconductor was evaluated as D; and the case where a large amount of the silica particles was deposited on the entire surface of the photoconductor was evaluated as E. In addition, the case where no silica particle was deposited on the photoconductor even after outputting another 100,000 sheets was evaluated as A.

Device Contamination

Using a modified device of Digital Color Imagio MP C7500 (manufactured by Ricoh Company Limited), an image chart having an imaging area rate of 50% was output on 100,000 sheets at monocolor mode. Thereafter, the contamination around the sheet discharging section of the fixing part was visually observed and evaluated as the device contamination. Note that, the case where no contamination was observed around the sheet discharging section was evaluated as A; the case where a slight contamination was observed around the sheet discharging section was evaluated as B; and the case where contaminations were observed around the sheet discharging section and on the print was evaluated as C.

Sheet Separation

One thousand sheets of NBS copy printing sheet <55> were continuously passed through, and the sheet separation was evaluated. Note that, the case where no jamming of the sheets occurred was evaluated as B; the case where the sheet jamming occurred 1 to 3 times was evaluated as C; and the case where the sheet jamming occurred 4 times or more was evaluated as D. In addition, the case where no jamming of the sheets occurred when tin paper (NBS copy printing sheet <45>) was passed through in the same manner as mentioned above was evaluated as A.

The evaluation results of the developers are shown in Table 3.

TABLE 3

| | Lowest fixing temperature [° C.] | Cleaning ability | Depositions of silica particles | Device contam-ination | Sheet separation |
|---|---|---|---|---|---|
| Ex. 1 | 135 | A | A | A | B |
| Ex. 2 | 135 | B | B | A | B |
| Ex. 3 | 135 | B | C | A | B |
| Ex. 4 | 130 | A | B | A | B |
| Ex. 5 | 140 | A | A | A | B |
| Ex. 6 | 135 | A | A | A | B |
| Ex. 7 | 135 | A | C | A | B |
| Ex. 8 | 135 | B | A | A | B |
| Ex. 9 | 135 | A | B | A | B |
| Ex. 10 | 135 | B | C | A | B |
| Comp. Ex. 1 | 140 | B | D | A | B |
| Comp. Ex. 2 | 135 | B | D | B | B |
| Comp. Ex. 3 | 135 | B | D | C | B |
| Comp. Ex. 4 | 135 | C | D | A | B |
| Comp. Ex. 5 | 135 | B | E | C | A |

From the results shown in Table 3, it was found that the toner of Examples had excellent results in the device contamination, particularly in the silica deposition, compared to the results of the toner of Comparative Examples.

This application claims priority to Japanese patent application Nos. 2010-165259, and 2011-096483, filed on Jul. 22, 2010, and Apr. 22, 2011, respectively, and incorporated herein by reference.

What is claimed is:

1. A toner, comprising:

base particles, each containing polyester, microcrystalline wax, and a colorant; and spherical silica particles having an average primary particle diameter of from 100 nm to 150 nm, wherein the microcrystalline wax has an onset temperature of from 45° C. to 60° C. as determined by DSC, and a carbon number distribution of from 25 to 55.

2. The toner according to claim 1, wherein the base particles each further contain a modified layered inorganic mineral in which at least part of interlayer cations are substituted with organic ions.

3. The toner according to claim 1, wherein the polyester contains urea-modified polyester.

4. The toner according to claim 1, further comprising resin particles present on a surface of each base particle.

5. The toner according to claim 4, wherein the resin particles are vinyl resin particles.

6. The toner according to claim 1, further comprising hydrophobic-processed silica particles having an average primary particle diameter of from 10 nm to 30 nm.

7. The toner according to claim 6, wherein a free particle rate of the spherical silica particles and the hydrophobic-processed silica particles is 30% by mass or less, and an amount of the spherical silica particles in the total of the free spherical silica particles and the free hydrophobic-processed silica particles is 50% by volume or less.

8. A method for producing a toner, comprising:

dissolving or dispersing a material containing polyester prepolymer containing an isocyanate group, a compound containing an amino group, microcrystalline wax, and a colorant in an organic solvent to prepare a first fluid;

emulsifying or dispersing the first fluid in an aqueous medium containing resin particles to prepare a second fluid;

removing the organic solvent from the second fluid to form base particles; and mixing the base particles with spherical silica particles having an average primary particle diameter of from 100 nm to 150 nm, wherein the microcrystalline wax has an onset temperature of from 45° C. to 60° C. as determined by DSC, and a carbon number distribution of from 25 to 55.

9. The method for producing a toner according to claim 8, wherein the mixing is performed by stirring using a flow-stirring mixer at a circumferential speed of from 65 m/s to 120 m/s, and T and Ts satisfies a relationship expressed by the following formula:

$$T \leq Ts-20,$$

wherein

T is a temperature for mixing the base particles and the spherical silica particles, Ts is an onset temperature of the microcrystalline wax as determined by DSC, and values of T and Ts are both based on a unit of ° C.

10. The method for producing a toner according to claim 8, wherein the base particles each further contain a modified layered inorganic mineral in which at least part of interlayer cations are substituted with organic ions.

11. The method for producing a toner according to claim 8, wherein the resin particles are located on a surface of each base particle.

12. The method for producing a toner according to claim 11, wherein the resin particles are vinyl resin particles.

13. A developer, comprising:

the toner as defined in claim 1.

14. The developer according to claim 13, wherein the base particles each further contain a modified layered inorganic mineral in which at least part of interlayer cations are substituted with organic ions.

15. The developer according to claim 13, wherein the toner further contains hydrophobic-processed silica particles having an average primary particle diameter of from 10 nm to 30 nm.

16. The developer according to claim 13, wherein the toner further contains hydrophobic-processed silica particles having an average primary particle diameter of from 10 nm to 30 nm, a free particle rate of the spherical silica particles and the hydrophobic-processed silica particles is 30% by mass or less, and an amount of the spherical silica particles in the total of the free spherical silica particles and the free hydrophobic-processed silica particles is 50% by volume or less.

17. An image forming method, comprising:

charging a photoconductor;

exposing the charged photoconductor to light to form a latent electrostatic image;

developing with the developer as defined in claim 13 the latent electrostatic image formed on the photoconductor to form a toner image;

transferring the toner image formed on the photoconductor to a recording medium; and fixing the transferred toner image to the recording medium.

18. The image forming method according to claim 17, wherein the base particles each further contain a modified layered inorganic mineral in which at least part of interlayer cations are substituted with organic ions.

19. The image forming method according to claim 17, wherein the toner further contains hydrophobic-processed silica particles having an average primary particle diameter of from 10 nm to 30 nm.

20. The image forming method according to claim 17, wherein the toner further contains hydrophobic-processed silica particles having an average primary particle diameter of from 10 nm to 30 nm, a free particle rate of the spherical silica particles and the hydrophobic-processed silica particles is 30% by mass or less, and an amount of the spherical silica particles in the total of the free spherical silica particles and the free hydrophobic-processed silica particles is 50% by volume or less.

* * * * *